US007052579B1

(12) United States Patent
Wai

(10) Patent No.: US 7,052,579 B1
(45) Date of Patent: May 30, 2006

(54) PITCH CONTROL COMPOSITION

(75) Inventor: George K. Wai, Mountain Lakes, NJ (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 08/689,193

(22) Filed: Aug. 5, 1996

(51) Int. Cl.
*D21H 21/02* (2006.01)

(52) U.S. Cl. ..... 162/48; 162/178; 162/199; 162/DIG. 4; 252/180

(58) Field of Classification Search ..... 162/168, 162/172, 175, 178, 199, DIG. 4, 48; 252/351, 252/356, 357, 60, 180
See application file for complete search history.

(56) References Cited

U.S. PATENT DOCUMENTS 3,992,249 A * 11/1976 Farley ..... 162/DIG. 4
4,755,259 A * 7/1988 Larsson ..... 162/178
4,946,557 A * 8/1990 Svending ..... 162/178
5,246,548 A * 9/1993 Aston et al. ..... 162/DIG. 4
5,292,403 A * 3/1994 Dreisbach et al. ..... 162/DIG. 4
5,300,194 A * 4/1994 Welkener et al. ..... 162/DIG. 4

FOREIGN PATENT DOCUMENTS

JP 55-84491 * 6/1980 ..... 162/DIG. 4

OTHER PUBLICATIONS

Louche et al, "The Role of Special Polyelectrolytes for the Solution of Operating Problems in Paper and Paper Board Production", *Product Information*, Buckman Laboratories, S.A. p. 1-25.*

* cited by examiner

*Primary Examiner*—Peter Chin
(74) *Attorney, Agent, or Firm*—David L. Hedden

(57) ABSTRACT

This invention relates to a liquid composition for the control of pitch deposition in pulp and paper making comprising an aqueous solution of (1) a cationic guar polymer, and (2) isobutylene/maleic anhydride copolymer. The invention also relates to a process for inhibiting pitch and stickies deposition in pulp and papermaking systems.

10 Claims, No Drawings

PITCH CONTROL COMPOSITION

TECHNICAL FIELD OF THE INVENTION

This invention relates to a liquid composition for the control of pitch deposition in pulp and paper making operations comprising an aqueous solution of (1) a derivatized cationic guar polymer, and (2) an alkali metal isobutylene/maleic anhydride copolymer. The invention also relates to a process for inhibiting stickies deposition on paper making equipment.

BACKGROUND OF THE INVENTION

In a broad sense, "pitch" is any "sticky" substance found in the pulp and papermaking process. These substances create quality and efficiency problems in the paper making process when they deposit on paper making equipment. More specifically "pitch" refers to any soluble organic matter originating from the extracts of wood during pulping which includes fatty acids and esters, resin acids, and sterols. Pitch may also include process additives such as defoamers, sizing agents, and coatings, as well as inorganic components like calcium carbonate, silica, clay, magnesium and titanium. Pitch is released from wood during chemical and mechanical pulping.

Fine particles of pitch that remain well-dispersed do not create a deposition problem. However, there is a tendency for the hydrophobic pitch particles to agglomerate at the air-water interface. These pitch particles form deposits due to their decreased solubility as they move downstream (through cooler temperatures and lower pH) and from the increased turbulence of the process. These pitch particles aggregate to form tacky threads or balls which then deposit on pulp and paper making equipment including chest walls, screens, paper machine headbox, wires, felts and dryers. This can also lead to sheet holes and breaks in paper resulting in increased downtime and/or lower quality paper. Such pitch deposition can be also be a problem in recycled or secondary fiber processes where synthetic organic polymeric organo-soluble pitch contaminants called "stickies", such as hot melts, polyethylene films, latexes, pressure sensitive adhesives, and waxes agglomerate and form deposits on papermaking equipment.

Typically used pitch control agents include nonionic surfactants, especially nonylphenol ethoxylates, talc and alum. Nonionic surfactants, which contain both a hydrophobic and hydrophilic segment, decrease the surface tension, provide wetting, detergency and dispersancy. However, nonylphenol ethoxylates have a high foaming tendency which may result in higher defoamer usage, thus depositing more pitch.

Talc is also used to control pitch deposition by adsorbing colloidal pitch onto the talc particles so it is retained in the sheet. The disadvantage of using talc is that it tends to deposit further downstream especially in paper machine felts and cause felt plugging. In acid paper making systems, alum or aluminum sulfate is used to decrease the tackiness of the pitch by cationic fixation to pulp. When using alum, pH control is critical to prevent deposition of alum.

Inorganic dispersants like sodium polyacrylate, and similar compounds, sequester or chelate the inorganic portion of the pitch particle, but leave the organic part free to interfere with low foam tolerant processes as well as increase defoamer usage.

Current technology in pitch or stickies control involves the use of detackifiers, which are hydrophilic polymers, to treat the hydrophobic pitch or stickies. The hydrophilic polymers are adsorbed onto the hydrophobic pitch or stickies particles, thereby converting the hydrophobic pitch or stickies particles to hydrophilic particles. The pitch or stickies particles, which are now hydrophilic, are likely stay with the pulp or paper and less likely to deposit on any kind of machinery, felt or wire surfaces.

Some known detackifiers are polyvinyl alcohol (PVA)[1], methylcellulose[2], and polyvinylacetate/ethyleneoxide[3].

[1] See U.S. Pat. No. 4,871,424.

[2] See U.S. Pat. No. 4,846,933.

[3] See U.S. Pat. No. 5,266,166.

SUMMARY OF THE INVENTION

This invention relates to a liquid composition for the control of pitch deposition in pulp and paper making comprising:

(1) a derivatized cationic guar polymer, and (2) an alkali metal salt of isobutylene/maleic anhydride copolymer.

The invention also relates to a process for inhibiting pitch deposition on paper making equipment. It can be used on hardwood and softwood pulp and papermaking processes for recycled fibers.

The subject compositions not only detackify pitch or stickies particles, but will disperse such particle and prevent them from agglomerating. The ionic balance of the papermaking system is not disturbed, thus limiting detrimental interactions with other process additives. Additionally, the liquid composition does not generate additional foam for the system to handle.

ENABLING DISCLOSURE AND BEST MODE

The derivatized cationic guar polymer used in the pitch inhibiting composition is a powder. Guar gum is a nonionic galactomannan (MW=250,000 to 2 million) as obtained from the endosperm of the seed of the guar plant. To charge the guar, the nonionic guar is reacted with hydroxypropyl trimonium chloride to a certain degree of substitution which establishes the amount of cationic charge or charge density value in meq/g according to a proprietary process. The resulting cationic guar polymer is a polymer without any significant surface-active properties. Preferred derivatized cationic guars have a charge density of 0.01 meq/g to 3.0 meq/g, preferably 0.01 meq/g to 0.15 meq/g. Particularly preferred as the derivatized cationic guar polymers are hydroxypropyl trimonium chloride, N-HANCE 3000, GALACTOSOL 80$H_2C$, and JAGUAR 8913,8914 and 8917.

The isobutylene/maleic anhydride copolymers have an average molecular weight of 5,000 to 100,000, preferably 10,000 to 20,000. They are prepared by the copolymerization of isobutylene and maleic anhydride monomers according to well known methods in the art. Preferred are the sodium salts of isobutylene/maleic anhydride such as TAMOL 731 supplied by Rohm and Hass Company.

The formulation of the pitch control composition is such that it may contain from 1–20 weight percent cationic guar and 1–20 weight percent isobutylene/maleic anhydride copolymer stabilized in an aqueous solution, said weight percents being based upon the total weight of the aqueous pitch control solution. Preferably the weight ratio of cationic guar to isobutylene/maleic anhydride copolymer is from 6:1 to 1:6, preferably from 5:1 to 1:5, more preferably from 3:1 to 1:3, and most preferably 2.1 to 1.2.

The pitch control composition may be stabilized with an acid, typically up to 0.5 percent by weight, preferably about 0.30 percent by weight (hydrochloric, sulfuric, phosphoric, acetic or nitric) for viscosity modification to impart flow characteristics, where said weight percent is based upon the weight of aqueous pitch control composition.

The invention also relates to a process for inhibiting stickies deposition on paper making equipment, especially when processing recycled paper. The amount of deposit control composition needed to effectively reduce the amount of sticky substances in the paper pulp is from 0.1 lb. to 10 lbs. Based upon the weight of the dry fiber. The pitch control composition can be added to any feedpoint in the pulp and papermaking process, for instance the first, second, or third stage washers of the pulp mill, the deckers of the pulpmill, the screens, post bleaching operations, and the paper machine itself.

The pitch control compositions reduce pitch deposition under Kraft brownstock washer/screen room conditions in laboratory simulations at a dosage of 0.10 ppm to 100 ppm as active, preferably at a dosage of 50 ppm, most preferably at a dosage of 15 ppm to 50 ppm and under both acid and alkaline conditions.

Preparation of Synthetic Pitch

The first pitch evaluation test method used involved the addition of a synthetic pitch to a 0.5% consistency of bleached hardwood pulp at 50° C. The synthetic pitch was a sodium soap of a tall oil fatty acid in ethanol.

The treated samples were prepared by adding aqueous solutions of the polymers listed in the Table I to the pulp slurry an amount of 50 ppm based upon the amount of the sample treated. The polymer solutions were added to the slurry with agitation provided by a propeller-type mixer.

Following the addition of treatment compound, a solution of calcium chloride was added to the slurry to create a colloidal pitch solution. The pH of the slurry dropped from 11.0 to 10.8–10.5 range. Agitation and slurry temperature were maintained for a period of 10 minutes. The mechanical shearing together with the pH drop forced the pitch out of solution and where it was deposited on the sides the steel beaker, and the blades and shaft of the mixer head. After mixing, the beaker and mixer were gently rinsed to remove loose fibers.

The amount of deposition was determined by the difference of the initial weights of the beaker and agitator subtracted from the oven-dried final weights. The pitch reduction or inhibition, expressed as a percent, was based on the difference between deposit weight gain on the untreated and treated samples divided by the same untreated sample weight.

The specific pitch control agents tested are set forth in Table I. The Blank did not contain a pitch control agent. Comparison Examples A–E are pitch control agents outside the scope of this invention and were tested for comparison purposes. The pitch control agent used in the Example 1 is within the scope of this invention, and is a blend of a cationic guar and an isobutylene/maleic anhydride copolymer where the weight ratio is 1:1. The results of the tests at a pH of 10.0 to 10.5 are set forth in Table II.

TABLE I

DESCRIPTION OF PITCH CONTROL AGENTS TESTED

| Pitch Control Agent | Description |
|---|---|
| Blank | Test with no additive |
| Comparison A | Nonylphenol ethoxylated with 9 moles of ethylene oxide |
| Comparison B | Dispersant/surfactant blend |
| Comparison C | SOKALAN HP 22 (polyoxyethylene/vinyl acetate copolymer) sold by BASF |
| Comparison D | Derivatized cationic guar |
| Comparison E | Sodium salt of isobutylene maleic anhydride |
| Blend F/Example 1 | Derivatized guar/isobutylene maleic blend (TAMOL 731 sold by Rhom and Haas Company) |

Table I

Comparison of Blends of Derivatized Cationic Guar and Isobutylene/Maleic Anhydride Copolymer with Other Pitch Dispersants (pH=10.0–10.5)

As the results in Table II show, the cationic guar polymer/isobutylene maleic blend of Example 1, having a weight ratio of cationic guar polymer to isobutylene/maleic anhydride copolymer of 1:1, shows the smallest pitch weight gain, or highest percentage pitch reduction, under conditions at a pH 10.0 to 10.5. This indicates the pitch control agent of Example 1 is the best of the 5 products tested, including the patented SOKALAN HP 22 (Blend C). It is also superior to conventional pitch control agents, the foamy surfactant (Blend A) and dispersant/surfactant (Blend B) which were all used successfully in brownstock washer/screen room applications.

TABLE II (PITCH DISPERSANT TESTS AT A PULPING pH = 10.0–10.5)

| Treatment | Active Dosage (ppm) | Pitch Deposition (mg) | % Pitch Reduction |
|---|---|---|---|
| Blank | 0 | 109.7 | 0 |
| Blend A | 50 | 60.4 | 44.9 |
| Blend B | 50 | 84.8 | 22.7 |
| Blend C | 50 | 38.1 | 65.2 |
| Blend D | 50 | 22.7 | 79.3 |
| Blend E | 50 | 36.1 | 67.1 |
| Blend F Example 1 | 50 | 11.2 | 89.8 |

Another test was performed to evaluate the efficacy of various treatments for post-bleaching or papermachine applications at a lower pH. The same test procedure was used as that used for the Examples described in Table II, except the final slurry had a pH of 6.5–7.0. The pulp slurry consistency was increased to 1.0%. The results of this test appear in Table III.

TABLE III (PITCH DISPERSANT TESTS AT A PULPING pH = 6.5–7.0)

| Treatment | Active Dosage (ppm) | Pitch Deposition (mg) | % Pitch Reduction |
|---|---|---|---|
| Blank | 0 | 789.7 | 0 |
| Blend A | 10 | 560.9 | 29.97 |
| Blend B | 10 | 652.5 | 11.68 |
| Blend C | 10 | 194.1 | 73.73 |
| Example 2 (Blend F) | 10 | 93.4 | 89.31 |

The results in Table III indicate that the cationic guar polymer/isobutylene maleic acid copolymer (Blend F/Example 2) is again better than the SOKALAN HP 22 (Blend B) and the best of all 5 tested products in acid to neutral pH, which is a condition normally encountered in papermachine systems.

To further illustrate the effectiveness of the pitch control agents within the scope of this invention, an actual sulfite mill pitch was used as a source of pitch deposit. This test method involved the pulping of a 1.0% consistency bleached hardwood pulp at 45° C. For one set of this tests, the pH of the slurry was adjusted to 4.0, while in another the slurry pH was at 8.0. A 2"×3" piece of polyester film, suspended in the slurry, was used as an additional pitch collector.

Following treatment addition, the sulfite pitch first dispersed in acetone/hexane solution. This solution was then slowly introduced into the slurry and mixed for an additional 10 minutes while maintaining temperature. At the end of the mixing time, the film, beaker, and mixer were gently rinsed to remove loose fibers. The same percentage pitch reduction calculation was used to determine treatment efficacy. The results of these two sets of tests are in Table IV.

TABLE IV (TESTS USING SULFITE MILL PITCH)

| | SLURRY pH = 4.0 | | | SLURRY pH = 8.0 | | |
|---|---|---|---|---|---|---|
| Treatment | Active Dosage (ppm) | Pitch Deposition (mg) | % Pitch Reduction | Active Dosage (ppm) | Pitch Deposition (mg) | % Pitch Reduction |
| Blank | 0 | 96 | 0 | 0 | 98.6 | 0 |
| A | 50 | 75.8 | 21 | 50 | 48.7 | 50.6 |
| B | 50 | 32 | 66.7 | 50 | 37.6 | 61.9 |
| C | 50 | 22 | 77.1 | 50 | 30.1 | 69.5 |
| D | 50 | 28.2 | 70.6 | 50 | 51.4 | 47.9 |
| EXAMPLE 3 (Blend F) | 50 | 17.5 | 81.8 | 50 | 18.4 | 81.3 |

As can be seen from these results, the composition of cationic guar polymer/isobutylene maleic anhydride copolymer Example 3(Blend F), used as a detackifier, is a more effective pitch controlling agent than industry accepted products (Blends A–D). The results show that Blend F is effective at different pH levels which is not observed when the comparison products are used. These results also confirm the earlier findings, that blend E, at equivalent dose, is more effective than the patented SOKALAN HP-22.

We claim:

1. A liquid composition for the control of pitch deposition in pulp and paper making comprising in aqueous solution:

(a) a derivatized cationic guar polymer having a charge density of the derivatized cationic guar polymer is from 0.01 meq/g. to 3.0 meq/g., and (b) an isobutylene/maleic anhydride copolymer having an average molecular weight of from 5,000 to 100,000, such that the weight ratio of cationic guar to isobutylene/maleic anhydride copolymer is from 6:1 to 1:6.

2. The pitch control composition of claim 1 wherein the isobutylene/maleic anhydride copolymer has an average molecular weight of from 10,000 to 20,000.

3. The pitch control composition of claim 2 wherein the charge of the cationic guar polymer is derived from hydroxypropyl trimonium chloride.

4. The pitch control composition claim 3 wherein the charge density of the derivatized cationic guar polymer is from 0.01 meq/g. to 3.0 meq/g.

5. The pitch control composition of claim 4 wherein the isobutylene/maleic anhydride copolymer has an average molecular weight of from 10,000 to 20,000.

6. A process for controlling the deposition of pitch in a hardwood or softwood pulp or papermaking process which comprises applying an effective pitch retarding amount of the composition of claim 5 to a feedpoint in the pulp or papermaking process.

7. The process of claim 6 wherein the pitch is pulp mill pitch and the composition of claim 5 wherein the feedpoint is the brown stock washer, screen room, or decker processing areas.

8. The process of claim 6 wherein the composition of claim 5 wherein the feedpoint is the post bleaching operation or the paper machine.

9. The process of claim 6 wherein the composition of claim 5 is applied directly to equipment used in pulp and papermaking.

10. The process of claim 6 wherein the composition of claim 5 is applied to the equipment of the pulp and papermaking process and through the shower process water.

* * * * *